US005290372A

United States Patent [19]

Choi et al.

[11] Patent Number: 5,290,372

[45] Date of Patent: Mar. 1, 1994

[54] FE-MN GROUP VIBRATION DAMPING ALLOY MANUFACTURING METHOD THEREOF

[75] Inventors: Jong-Sul Choi; Seung-Han Baek; Jun-Dong Kim, all of Seoul, Rep. of Korea

[73] Assignee: Woojin Osk Corporation, Kyungki, Rep. of Korea

[21] Appl. No.: 963,931

[22] Filed: Oct. 19, 1992

Related U.S. Application Data

[63] Continuation of Ser. No. 750,150, Aug. 26, 1991, abandoned.

[30] Foreign Application Priority Data

Aug. 27, 1990 [KR] Rep. of Korea ..... 13216/1990

[51] Int. Cl.[5] ..... C21D 8/00

[52] U.S. Cl. ..... 148/540; 148/546; 148/547; 148/619; 148/620; 148/329

[58] Field of Search ..... 148/619, 620, 329, 540, 148/546, 547; 420/72

[56] References Cited

U.S. PATENT DOCUMENTS

| | | | |
|---|---|---|---|
| 1,278,207 | 9/1918 | Potter | 148/620 |
| 4,875,933 | 10/1989 | Wan | 420/72 |

FOREIGN PATENT DOCUMENTS

| | | | |
|---|---|---|---|
| 0091956 | 7/1980 | Japan | 420/72 |
| 63-216946 | 9/1988 | Japan | C22C 38/04 |
| 0678074 | 8/1979 | U.S.S.R. | 420/72 |
| 0013847 | of 1894 | United Kingdom | 420/72 |

*Primary Examiner*—R. Dean
*Assistant Examiner*—Sikyin Ip
*Attorney, Agent, or Firm*—Skjerven, Morrill, MacPherson, Franklin & Friel

[57] ABSTRACT

A vibration damping alloy has a mixed structure of martensite and austenite. The alloy steel is iron-based to which 14–22% by weight of manganese is added. The vibration damping alloy is manufactured by mixing electrolytic iron and manganese in a molten state. The molten mixture, containing 14–22% of manganese with the remander of iron, is cast as an ingot. The ingot is homogenized at 1000°–1300° C. for 20–40 hours and then hot rolled at 900°–1100° C. for 20 minutes to 90 minutes. The ingot is cooled with air or water.

3 Claims, 2 Drawing Sheets

FE-MN GROUP VIBRATION DAMPING ALLOY MANUFACTURING METHOD THEREOF

This application is a continuation of application Ser. No. 07/750,150, filed Aug. 26, 1991 now abandoned.

BACKGROUND OF THE INVENTION

The present invention relates to a vibration preventing alloy having a vibration damping ability, and more particularly, to an iron (Fe-Mn) vibration damping alloy having an excellent damping ability with keeping a high strengh and manufacturing method thereof.

Recently, in order to prevent vibration and rumbling sound generated from various machines and instruments such as aircraft, ship, vehicle, machinery, precision machine and the like, using of vibration preventing alloy material is widely spread.

As conventional vibration preventing alloy, Cu-Mn alloy, Ni-Ti alloy, and stainless steel alloy utilizing a twin crystalline transformation have been known.

Such alloys are excellent at adjacent of normal temperature in damping ability, but as they use expensive metals it causes an increasing factor of manufacturing cost, and cold workability is inferior as well as preciseness and complexity are required on manufacturing process in response to respective element.

Further, Al-Zn alloy and cast iron group alloy are in a state of not capable of satisfying a tensile strength as well as hardness value.

On the other hand, a vibration preventing alloy of austenite group being of high Mn steel is known in Japanese laid open patent publication No. 56-258.

This alloy is added with element of chrome, aluminium or Mo, V, Nb, Ti and the like so that it causes an increasing factor of manufacturing cost, and in order to obtain a stable austenite structure, appropriate physical property is required to the austenite such as it requires to closely adjust particularly the contents of carbon (C) and chromium (Cr) among the containing ingredients.

As important forms producing the vibration damping, there are divided into generally three kinds of absorption form, resonance form and historical form.

Damping by absorption form does not depend on an amplitude of vibration but depends on a vibrating frequency numbers, and it is not so greatly considered in view of vibration preventing.

Resonance form does not depend on an amplitude of vibration in a damping ability as same as the absorption form but depends on a vibration frequency numbers, and in this case, maximum damping ability appears when it is in a resonant vibrating frequency.

However, the damping ability of such form is not so greatly important in its function in view of a vibration preventing alloy.

Historical form is a damping form produced due to those courses of stress/strain deformation rates in case of applying a stress from exterior and removing said stress are different each other, and at this moment, an energy as much as corresponding to historical loss becomes a cause of damping.

Accordingly, the damping ability of this form has a property which has no relation with vibration frequency but greatly depends on the transformation amplitude.

Since such historical form has a case of showing up a great damping ability regardless of vibration frequency, it may have a vibration preventing effect industrially.

OBJECT OF THE INVENTION

Therefore, the alloy of the present invention is that which has developed a historical form vibration preventing alloy, and it is an object of the present invention to provide a vibration dampable alloy of inexpensive cost in which (Fe) is a base to which manganese (Mn) is added so that excellent dampable alloy can be obtained without employing expensive elements as the conventional with keeping a high strength as well as it is utilized at normal temperature and so on.

The foregoing and other objects as well as advantages of the present invention will become clear by following description of the invention with reference to the accompanying drawings.

BRIEF DESCRIPTION OF THE DRAWINGS

For a better understanding of the invention, and to show how the same may be carried out into effect, reference will now be made, by way of example, with respect to the accompanying drawings, in which.

DETAILED DESCRIPTION OF THE INVENTION

Hereinafter, the present invention will be described in detail with reference to the accompanying drawings.

The present invention is a Fe-Mn group vibration dampable alloy which is a martensite structure in which Fe is a base to which Mn is added with 10–22% by weight %.

In manufacturing an alloy according to the present invention, firstly an electrolytic iron and an electrolytic manganese are prepared at a composition rate as usual, and at an induction furnace or at an electric furnace, a temperature of the furnace is made more than 1500° C. and firstly the electrolytic iron is melted and then, after the electrolytic iron is melted, the electrolytic manganese is put therein to thereby be molten.

Thereafter, it is casted in a mold to thereby make ingot.

This is processed to be homogenized at the temperature of 1000°–1300° C. for 20–40 hours and thereafter it is hot rolled to thereby manufacture into a dimension of a predetermined shape.

And when it is heated at the temperature of 900°–1100° C. for about 20–90 minutes, and preferably, for 30–60 minutes and thereafter it is air cooled or water cooled, an alloy steel of the invention which is a martensite structure is obtained.

In the present invention, the reason why the amount of Mn is made to a composition of 10–22% by weight is because $\alpha'$—martensite is produced up to 10% Mn, $\epsilon$—martensite is started to be produced at over 10% Mn, and it becomes an austenite structure at more than 28% Mn, and $\alpha'$—martensite structure is less in vibration damping ability and $\epsilon$—martensite structure is very great in vibration damping ability, and hence it is made to be of 10–22% which is a range of excellence in vibration damping ability.

Although the present invention does not particularly define with regard to elements of C, Si, P and S, since the present invention is a high Mn steel and is for obtaining a martensite structure, it is considered that influence for the elements of C an Si does not so, greatly function.

And, P and S are inevitable inpurities and have no particular problem if it would be more than a range to affect any influence to the alloy, therefore it is not separately defined.

Further, the homogenizing process conditions (temperature, time period) are for completely solid dissolving the Mn and other impurity elements within austenite.

And next, operation and effect of the present invention will be described in detail in accordance with examples of tables 1–3 and FIGS. 1 to 3.

Figure 1:
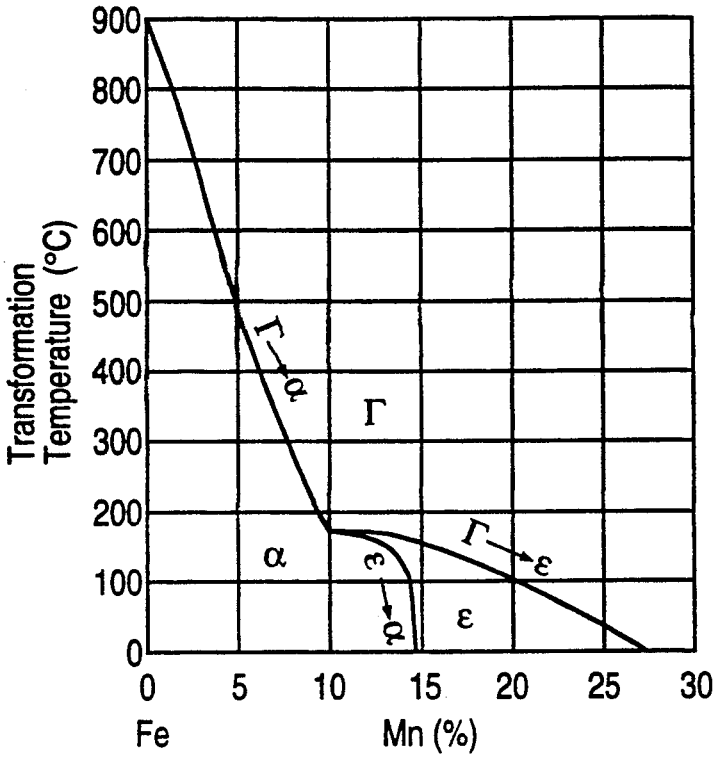
FIG. 1 is a binary group constitutional diagram of Fe-Mn alloy.
Figure 2:
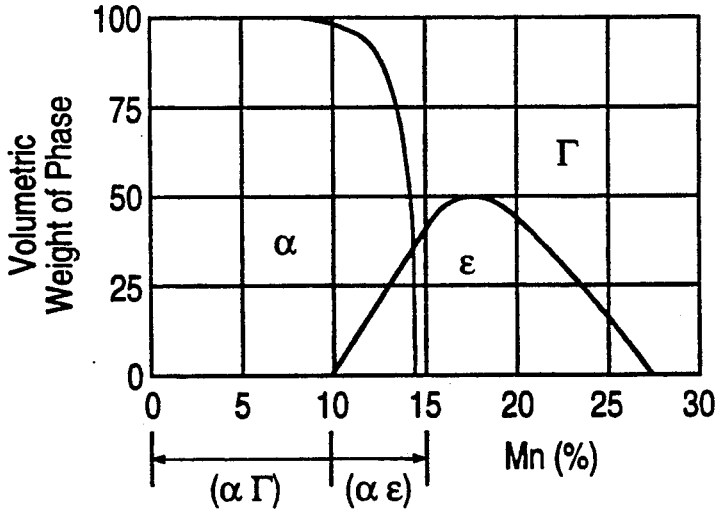
FIG. 2 is a diagram for illustrating transformation amount of Fe-Mn alloy.

FIGS. 1 and 2 show a Fe side portion of Fe-Mn binary constitutional diagram which is a base of the present invention, and a transformation point of said constitutional diagram is determined by cooling with cooling speed of 3° C./min and thereafter by executing thermal expansion test, magnetic analysis, X-ray diffraction test and optical microscopic test.

In FIG. 1, $\alpha'$—martensite is produced up to 10% Mn, a mixture martensite of $\alpha'+\epsilon$ is produced at 10–15% Mn, and $\epsilon$—martensite is produced at 15–28% Mn.

FIG. 2 shows that each Mn alloy is heated at 1000° C. and it is air cooled at normal temperature and thereafter volume rate of respective phase is examined by X-ray diffraction analyzing method.

As a result of researching as FIGS. 1 and 2, it could be understood that an alloy showing $\alpha'$—martensite structure as table 1 is very little in vibration damping ability, and an alloy showing $\epsilon$—martensite structure is very great in vibration damping ability and excellent also in tensile strength.

TABLE 1

Comparison of Vibration Damping Ability in Accordance with Martensite Strucure.

TABLE 1

Comparison of vibration damping ability in accordance with martensite structure.

| Alloy | Structure | Damping ability (SDC %) | Tensile strength (Kg/mm$^2$) |
|---|---|---|---|
| Fe-4% Mn | $\alpha'$-martensite | 14 | 60 |
| Fe-17% Mn | $\epsilon$-martensite | 25 | 65 |
| Low carbon steel | Tempered martensite | 7 | 63 |

It is judged that a reason why the $\epsilon$—martensite structure is greater than $\alpha'$—martensite structure in vibration damping ability is because a bottom structure of $\alpha'$—martensite is made of dislocation, while a bottom structure of $\epsilon$—martensite is made of fine twin crystal and thereby boundary of twin crystal is readily moved even by a slight external force therefore the $\epsilon$—martensite structure shows a high vibration damping ability.

TABLE 2

Comparison of Vibration Damping Ability in Accordance with Mn Composition Rate.

TABLE 2

Comparison of vibration damping ability in accordance with Mn composition rate.

| Name of alloy | | Damping ability air cooled | Damping ability water cooled |
|---|---|---|---|
| Comparative steel | Fe-4% Mn | 12 | 12 |
| This invention | Fe-14% Mn | 14 | 15 |
| | Fe-17% Mn | 25 | 26 |
| | Fe-20% Mn | 23 | 23.5 |
| | Fe-22% Mn | 15 | 16 |
| Comparative steel | Fe-24% Mn | 8 | 8.5 |
| | Fe-28% Mn | 5 | 5 |

As in above table 2, the alloy according to the invention was excellent in vibration damping ability without any large difference in air cooling or water cooling relative to the comparative steel.

TABLE 3

Comparison of Hardness After Water Cooling in Accordance with Mn Composition Rate.

TABLE 3

Comparison of hardness after water cooling in accordance with Mn composition rate.

| Name of alloy | | Hardness (HRB) |
|---|---|---|
| This invention | Fe-14% Mn | 90 |
| | Fe-17% Mn | 93 |
| | Fe-22% Mn | 88 |
| Comparative steel | Fe-24% Mn | 85 |
| | Fe-28% Mn | 60 |

As in above table 3, in case of the present invention, hardness value is a range of 88–90 whereas the comparative steel is less than 85, and particularly in case of Fe—28% Mn, it is appeared to be lowered to 60 because it is an austenite structure.

And, FIG. 3s show respectively an amplitude damping curve in case when a bar-like test piece is vibrated at $\gamma=2\times10^4$ of maximum surface deformation rate.

Figure 3A:
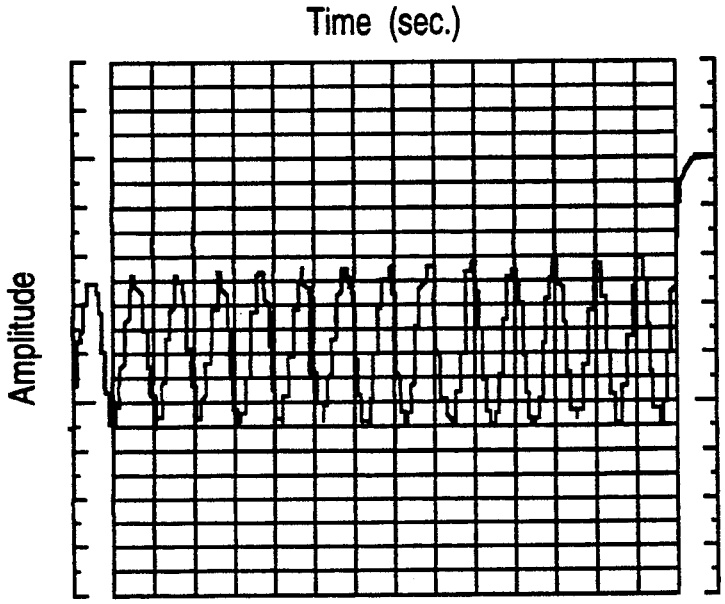
FIG. 3 is a graph of curve for illustrating vibration damping of Fe-Mn alloy, in which FIG. 3 (A) is a constitutional diagram of Fe-4% Mn alloy, and FIG. 3 (B) is a constitutional diagram of Fe-17% Mn alloy.
Figure 3B:
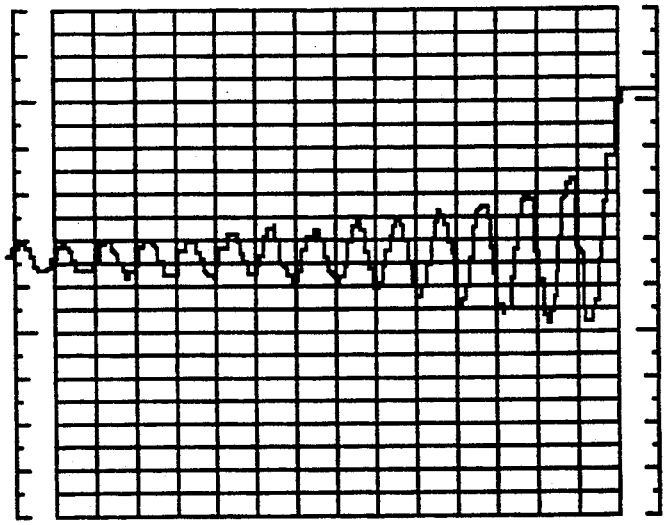
Figure 1:
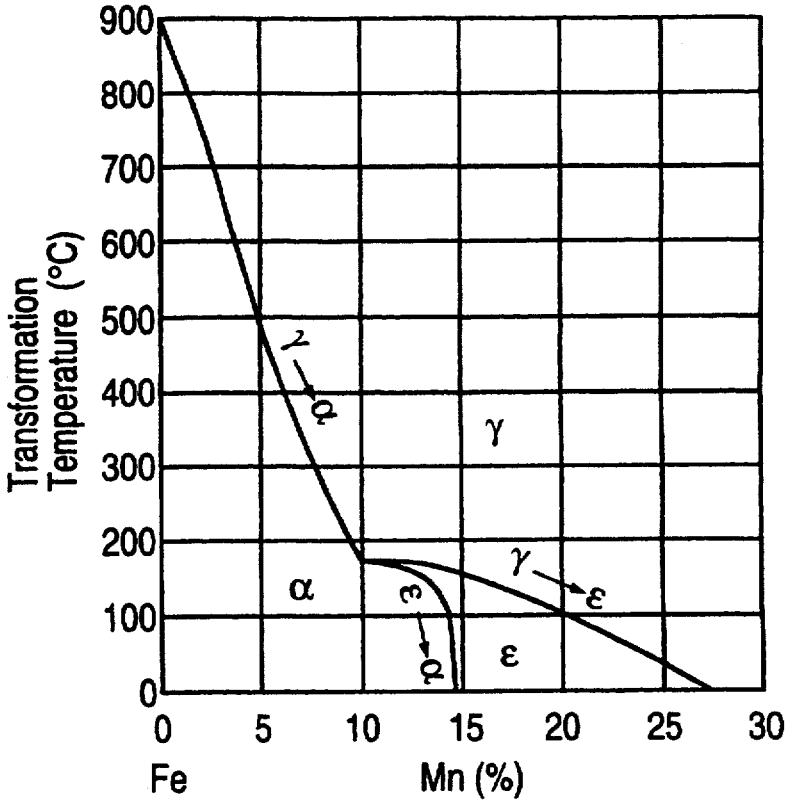
Figure 2:
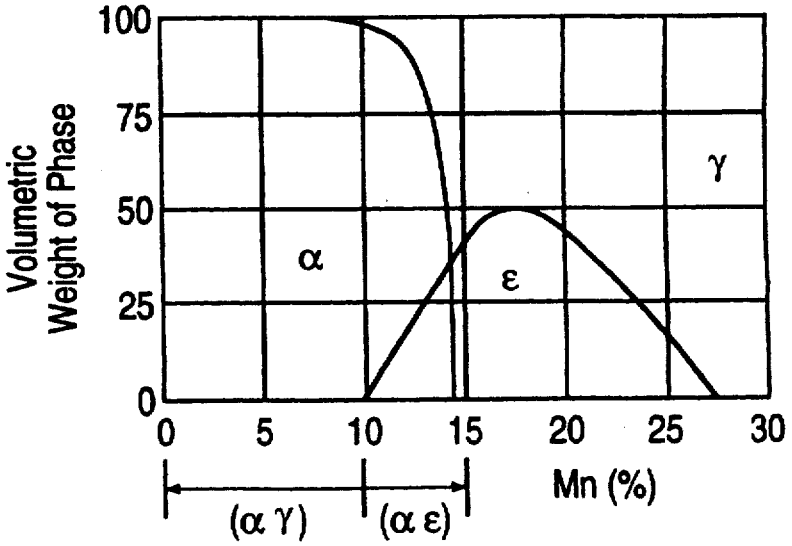
Figure 3A:
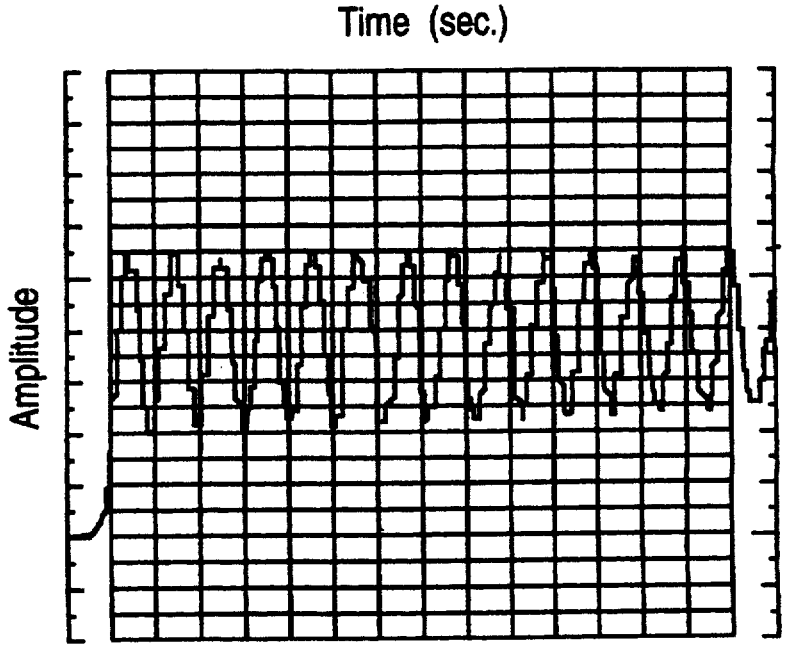
Figure 3B:
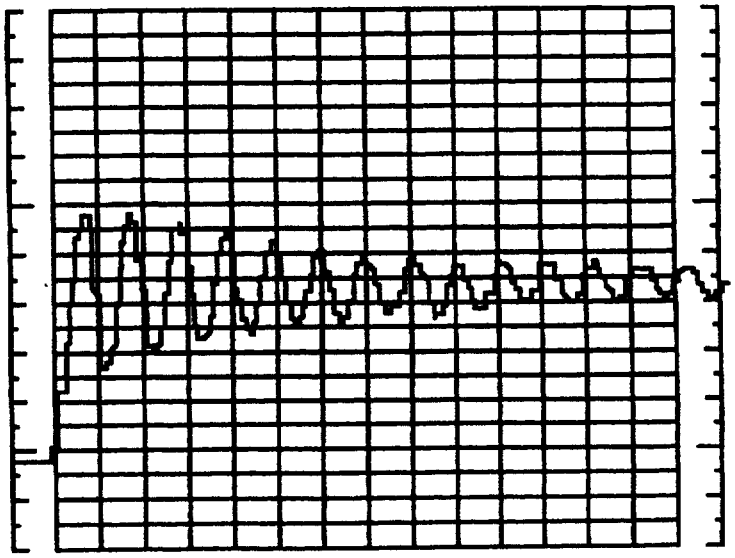

FIG. 3 (A) is that of Fe—4% Mn steel which is $\alpha'$—martensite structure, and amplitude is almost not changed in response to elapse of time, however FIG. 3(B) is that of Fe—17% Mn steel which is $\epsilon$—martensite structure, and amplitude is rapidly damped and disappeared in response to elapse of time.

Therefore, it can be clearly appreciated that those of included within Mn range of the present invention is excellent in vibration damping ability relative to the comparative steel.

It will be appreciated that the present invention is not restricted to the particular embodiment that has been described hereinbefore, and that variations and modifications may be made therein without departing from the spirit and scope of the invention as defined in the appended claims and equivalents thereof.

What is claimed is:

1. An Fe-Mn vibration damping alloy having a mixed structure of martensite and austenite, said alloy consisting essentially of Fe and Mn, wherein said alloy is iron-based, is 14–22% by weight manganese, and is produced by:

a. melting and mixing electrolytic iron and electrolytic manganese so that the resulting mixture contains 14–22% manganese by weight;

b. subsequently casting the mixture into a mold to produce a molten metal ingot;

c. subsequently heating the molten metal ingot at a temperature from about 1000° C. to about 1300° C. for 20–40 hours to produce a homogenized metal ingot;

d. subsequently hot-rolling the homogenized metal ingot at a temperature from about 900° C. to about 1100° C. for a total of 20–90 minutes to produce a rolled metal; and e. subsequently cooling the rolled metal by air or water cooling at room temperature.

2. A method for manufacturing Fe-Mn vibration damping alloy comprising:

a. melting and mixing electrolytic iron and electrolytic manganese so that the resulting mixture contains 14–22% manganese by weight;

b. subsequently casting the mixture into a mold to produce a molten metal ingot;

c. subsequently heating the molten metal ingot at a temperature from about 1000° C. to about 1300° C. for 20–40 hours to produce a homogenized metal ingot;

d. subsequently hot-rolling the homogenized metal ingot at a temperature from about 900° C. to about 1100° C. for 20–90 minutes to produce a rolled metal; and e. subsequently cooling the rolled metal by air or water cooling at room temperature.

3. The method of claim 2, wherein the hot-rolling step is carried out for a total of 30–60 minutes.

* * * * *

UNITED STATES PATENT AND TRADEMARK OFFICE

CERTIFICATE OF CORRECTION

PATENT NO. : 5,290,372
DATED : March 1, 1994
INVENTOR(S) : Chong-Sool Choi, et. al.

It is certified that error appears in the above-identified patent and that said Letters Patent is hereby corrected as shown below:

The Title page, should be deleted to be replaced with the attached Title page.

Drawings:

Delete drawing sheets consisting of Figs. 1, 2, 3A and 3B and substitute Figs. 1, 2, 3A and 3B, as shown on the attached pages.

Title page, item [75], inventor: delete "Jong - Sul choi, and insert --Chong Sool Choi--.

Title page, item {57], Abstract, line 7, delete "remander", and insert --remainder--.

Signed and Sealed this

Thirtieth Day of June, 1998

*Attest:*

*Attesting Officer*

BRUCE LEHMAN

*Commissioner of Patents and Trademarks*

United States Patent [19]

Choi et al.

[11] Patent Number: 5,290,372

[45] Date of Patent: Mar. 1, 1994

[54] FE-MN GROUP VIBRATION DAMPING ALLOY MANUFACTURING METHOD THEREOF

[75] Inventors: Jong-Sul Choi; Seung-Han Baek; Jun-Dong Kim, all of Seoul, Rep. of Korea

[73] Assignee: Woojin Osk Corporation, Kyungki, Rep. of Korea

[21] Appl. No.: 963,931

[22] Filed: Oct. 19, 1992

Related U.S. Application Data

[63] Continuation of Ser. No. 750,150, Aug. 26, 1991, abandoned.

[30] Foreign Application Priority Data

Aug. 27, 1990 [KR] Rep. of Korea ..... 13216/1990

[51] Int. Cl.[5] ..... C21D 8/00

[52] U.S. Cl. ..... 148/540; 148/546; 148/547; 148/619; 148/620; 148/329

[58] Field of Search ..... 148/619, 620, 329, 540, 148/546, 547; 420/72

[56] References Cited

U.S. PATENT DOCUMENTS

| | | | |
|---|---|---|---|
| 1,278,207 | 9/1918 | Potter | 148/620 |
| 4,875,933 | 10/1989 | Wan | 420/72 |

FOREIGN PATENT DOCUMENTS

| | | | |
|---|---|---|---|
| 0091956 | 7/1980 | Japan | 420/72 |
| 63-216946 | 9/1988 | Japan | C22C 38/04 |
| 0678074 | 8/1979 | U.S.S.R. | 420/72 |
| 0013847 | of 1894 | United Kingdom | 420/72 |

*Primary Examiner*—R. Dean
*Assistant Examiner*—Sikyin Ip
*Attorney, Agent, or Firm*—Skjerven, Morrill, MacPherson, Franklin & Friel

[57] ABSTRACT

A vibration damping alloy has a mixed structure of martensite and austenite. The alloy steel is iron-based to which 14–22% by weight of manganese is added. The vibration damping alloy is manufactured by mixing electrolytic iron and manganese in a molten state. The molten mixture, containing 14–22% of manganese with the remainder of iron, is cast as an ingot. The ingot is homogenized at 1000°-1300° C. for 20–40 hours and then hot rolled at 900°-1100° C. for 20 minutes to 90 minutes. The ingot is cooled with air or water.

3 Claims, 2 Drawing Sheets

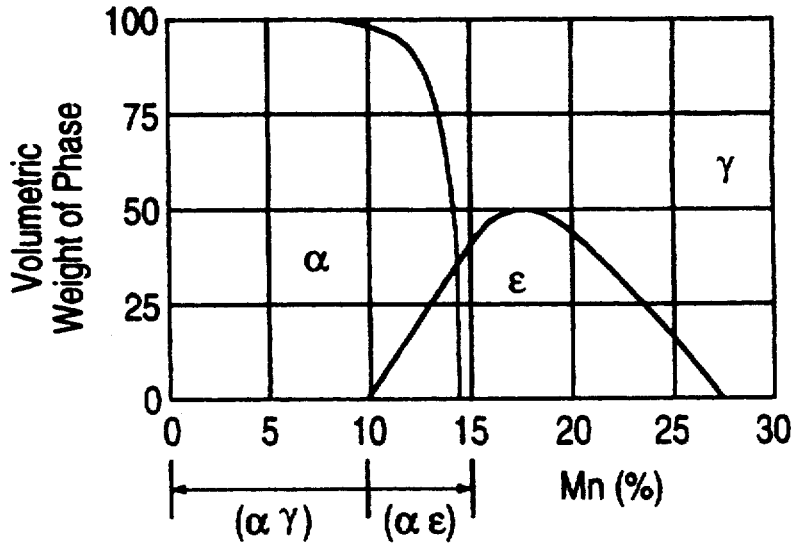

1/2